US010696084B1

(12) United States Patent
Dobashi

(10) Patent No.: US 10,696,084 B1
(45) Date of Patent: Jun. 30, 2020

(54) SHEET PROCESSING DEVICE AND IMAGE PROCESSING SYSTEM

(71) Applicant: TOSHIBA TEC KABUSHIKI KAISHA, Shinagawa-ku, Tokyo (JP)

(72) Inventor: Shoichi Dobashi, Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/280,066

(22) Filed: Feb. 20, 2019

(51) Int. Cl.

| | |
|---|---|
| ***B65H 31/24*** | (2006.01) |
| ***B42C 1/12*** | (2006.01) |
| ***B65H 31/30*** | (2006.01) |
| ***B65H 37/04*** | (2006.01) |

(52) U.S. Cl.

CPC ..... *B42C 1/125* (2013.01); *B65H 31/24* (2013.01); *B65H 31/3009* (2013.01); *B65H 31/3081* (2013.01); *B65H 37/04* (2013.01); *B65H 2301/36* (2013.01); *B65H 2301/446* (2013.01); *B65H 2408/1143* (2013.01); *B65H 2511/20* (2013.01); *B65H 2801/27* (2013.01)

(58) Field of Classification Search

CPC .... B42C 1/125; B65H 31/30; B65H 31/3081; B65H 37/04; B65H 2301/36; B65H 2301/446; B65H 2408/1143; B65H 2801/27

USPC ..... 270/58.07, 58.08, 58.11, 58.12, 58.17, 270/58.27

See application file for complete search history.

(56) References Cited

U.S. PATENT DOCUMENTS

| | | | | |
|---|---|---|---|---|
| 6,168,154 | B1 * | 1/2001 | Asahara | B42C 1/12 270/58.12 |
| 7,104,538 | B1 * | 9/2006 | Kimura | B42C 1/125 270/58.08 |
| 7,568,686 | B2 * | 8/2009 | Terao | B42C 1/12 270/58.07 |
| 7,896,332 | B2 * | 3/2011 | Terao | G03G 15/6532 198/834 |
| 7,984,900 | B2 * | 7/2011 | Terao | B65H 31/3081 270/58.12 |
| 8,162,307 | B2 | 4/2012 | Taki et al. | |
| 8,251,361 | B2 | 8/2012 | Taki et al. | |
| 9,586,781 | B2 * | 3/2017 | Sekigawa | B42B 9/00 |
| 9,617,110 | B2 * | 4/2017 | Sekigawa | B65H 39/00 |
| 9,919,892 | B1 * | 3/2018 | Kamata | B65H 31/34 |
| 10,046,940 | B2 * | 8/2018 | Obuchi | B65H 31/20 |
| 10,106,359 | B2 * | 10/2018 | Kamata | B65H 31/34 |
| 2009/0166946 | A1 * | 7/2009 | Iguchi | B65H 31/10 270/58.08 |

(Continued)

*Primary Examiner* — Leslie A Nicholson, III

(74) *Attorney, Agent, or Firm* — Amin, Turocy & Watson, LLP

(57) ABSTRACT

According to one embodiment, a sheet processing device includes a moving member, an extrusion member, a first motor, a second motor, a first power transmission unit, a second power transmission unit, and a shaft. The first motor drives the moving member. The second motor drives the extrusion member. The second motor is a motor separated from the first motor. The first power transmission unit includes a first rotor. The first power transmission unit transfers power from the first motor to the moving member. The second power transmission unit includes a second rotor. The second power transmission unit transfers power from the second motor to the extrusion member. The shaft supports the first rotor and the second rotor.

20 Claims, 9 Drawing Sheets

(56) References Cited

U.S. PATENT DOCUMENTS

| | | | | |
|---|---|---|---|---|
| 2010/0219576 | A1* | 9/2010 | Yamamoto | B65H 9/101<br>270/58.08 |
| 2018/0072084 | A1* | 3/2018 | Shimizu | B65H 37/04 |

* cited by examiner

SHEET PROCESSING DEVICE AND IMAGE PROCESSING SYSTEM

FIELD

Embodiments described herein relate generally to a sheet processing device and an image processing system.

BACKGROUND

There is known a sheet processing device which performs a post processing such as sorting and stapling on a recording medium (hereinafter, collectively referred to as "sheet") of a sheet shape conveyed from an image forming device. For example, the sheet processing device includes a standby unit, a processing unit, and a discharge unit. The standby unit temporally retains the sheet. The standby unit sends the retained sheet to the processing unit at a defined timing. The processing unit performs the post processing on the sheet received from the standby unit. The processing unit discharges the sheet subjected to the post processing to the discharge unit.

For example, the processing unit performs sorting and binding on a sheet bundle. The processing unit includes an ejector which supports the rear end of the sheet subjected to the sorting and the binding. The ejector moves from a home position to a downstream side in a sheet conveyance direction while pressing the sheet. The processing unit extrudes the sheet toward the discharge unit by an extrusion member when the ejector is moved up to a predetermined position. In other words, the ejector delivers the sheet to the extrusion member after the sheet is conveyed up to a predetermined delivery position. The ejector returns to the home position when the sheet is delivered to the extrusion member at the delivery position. If a spring is used as a power source for returning the ejector to the home position, there is a possibility to cause an impact noise when the ejector is stopped at the home position. If the impact noise occurs in a housing, the impact noise is propagated and increased, and becomes offensive to a user. Therefore, the ejector is configured to be driven by a motor to decelerate the ejector in front of the home position, so that the impact noise generated at the time of stopping can be suppressed. However, if the motor for driving the ejector is newly provided, the device is likely to be increased in size.

DETAILED DESCRIPTION

Figure 1:
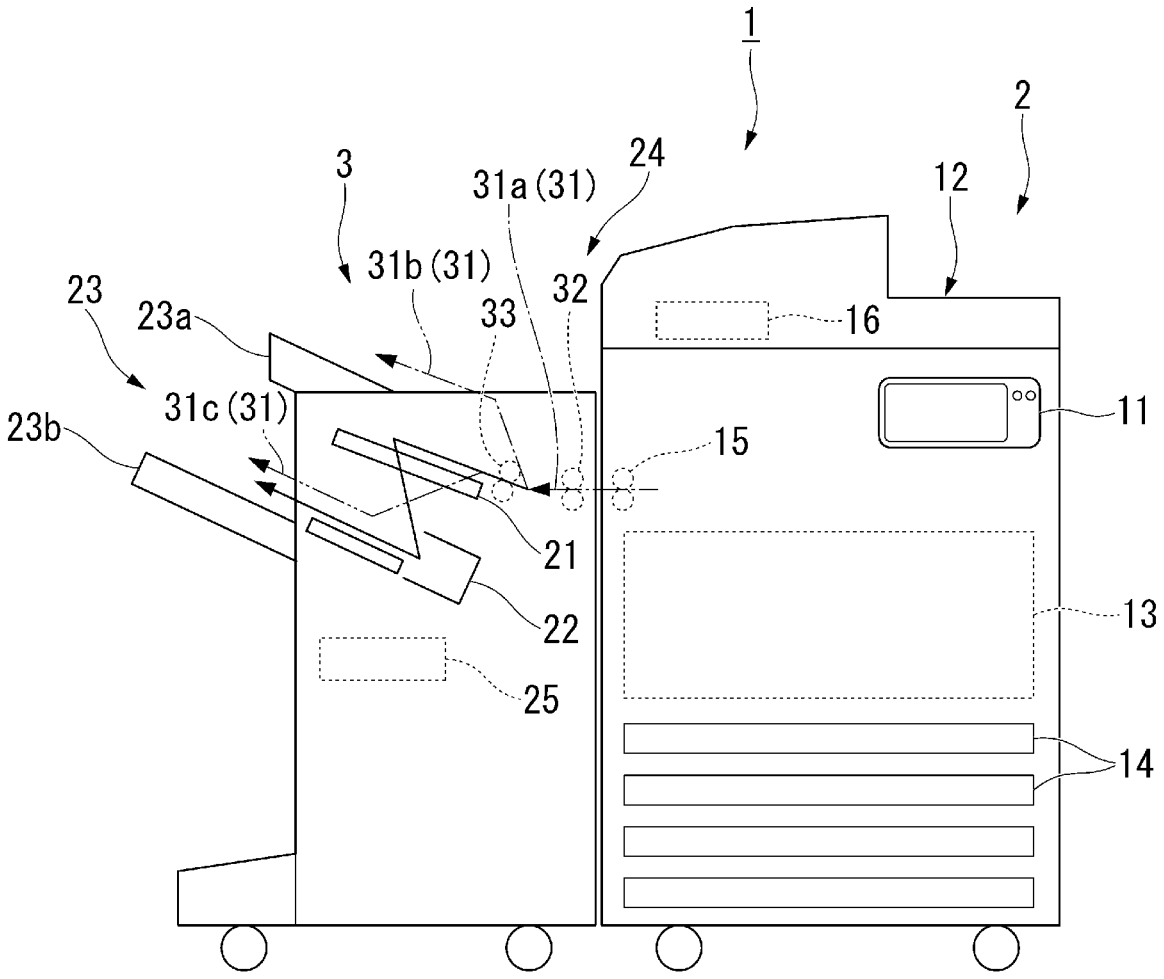
FIG. 1 is a diagram schematically illustrating an example of the entire configuration of an image forming system of an embodiment.

In general, according to one embodiment, a sheet processing device of an embodiment includes a processing tray, a moving member, an extrusion member, a first motor, a second motor, a first power transmission unit, a second power transmission unit, and a shaft. The moving member can come into contact with an end of a sheet mounted in the processing tray on an upstream side in a sheet conveyance direction. The moving member moves along the sheet conveyance direction while the contact with the sheet in a first region in the sheet conveyance direction. The extrusion member can come into contact with an end of the sheet mounted in the processing tray on the upstream side in the sheet conveyance direction. The extrusion member extrudes the sheet in a second region from the upstream side to the downstream side in the sheet conveyance direction, in which the second region is on a downstream side from the first region in the sheet conveyance direction. The first motor drives the moving member. The second motor drives the extrusion member. The second motor is a motor separated from the first motor. The first power transmission unit includes a first rotor. The first power transmission unit transfers power from the first motor to the moving member. The second power transmission unit includes a second rotor. The second power transmission unit transfers power from the second motor to the extrusion member. The shaft supports the first rotor and the second rotor.

Hereinafter, a sheet processing device and an image processing system of the embodiment will be described with reference to the drawings.

The same configuration in the drawings below will be denoted by the same symbol.

FIG. 1 is a diagram schematically illustrating an example of the entire configuration of an image forming system 1 of the embodiment.

As illustrated in FIG. 1, the image forming system 1 includes an image forming device 2 (image processing device) and a sheet processing device 3. The image forming device 2 forms an image on a sheet-like medium (hereinafter, collectively referred to as "sheet S") such as a paper sheet. The sheet processing device 3 performs a post processing on the sheet S which is discharged from the image forming device 2.

The image forming device 2 includes a control panel 11, a scanner unit 12, a printer unit 13, a sheet feeding unit 14, a sheet discharging unit 15, and an image forming control unit 16.

The control panel 11 includes an operation unit, a display unit, and a panel control unit. The operation unit receives a user's operation. For example, the operation unit includes various types of keys and a touch panel. The display unit displays various types of information. The panel control unit controls the operation unit to receive the reception of a user's operation, and the display unit to perform display. The panel control unit includes a control circuit which includes a central processing unit (CPU), a read only memory (ROM), and a random access memory (RAM).

For example, the control panel 11 receives an input related to the sheet S such as the size of the sheet S (sheet size) and the type of the sheet S. The sheet size includes a regular size and an irregular size. The type of the sheet S includes sheet quality, grammage, and thickness.

For example, the control panel 11 receives an input related to the type of the post processing of the sheet S. The control panel 11 receives a selection result among a plurality of different processing modes. The plurality of different processing modes include a sort mode, a staple mode, and a non-sort mode. The sort mode is a processing mode in which a sorting is performed. The staple mode is a processing mode in which a stapling (sheet binding) is performed. The non-sort mode is a processing mode in which the sorting and the stapling are prohibited. For example, the control panel 11 receives an input related to the number of sheets S (the number of stapling sheets) forming a sheet bundle SS when the selection of the staple mode is received.

For example, the control panel 11 receives a selection result among a plurality of discharge destinations of the sheet S when the non-sort mode is selected. The plurality of discharge destinations include a fixed tray 23*a* and a movable tray 23*b* described below.

The image forming device 2 sends the information on the sheet S and the information on the type of the post processing that the control panel 11 receives to the sheet processing device 3.

The scanner unit 12 includes a reading unit and a scanner control unit. The reading unit reads image information of a copying target as brightness and darkness of light. The scanner control unit controls the reading of the image information by the reading unit. The scanner control unit includes a control circuit which includes a CPU, a ROM, and a RAM. The scanner unit 12 sends the read image information to the printer unit 13.

The printer unit 13 forms an output image (hereinafter, referred to as "toner image") by a developer such as toner on the basis of the image information received from the scanner unit 12 or an external device. The printer unit 13 transfers the toner image onto the surface of the sheet S. The printer unit 13 applies heat and pressure to the toner image on the surface of the sheet S to fix the toner image to the sheet S. The printer unit 13 conveys the sheet S with the fixed toner image to the sheet discharging unit 15. The printer unit 13 includes a printer control unit. The printer control unit includes a control circuit which includes a CPU, a ROM, and a RAM. The printer control unit controls the printing of an image onto the sheet S by the printer unit 13.

The sheet feeding unit 14 supplies the sheets S one by one to the printer unit 13 at timing when the printer unit 13 forms the toner image. For example, the sheet feeding unit 14 includes a plurality of sheet feeding cassettes. Each sheet feeding cassette stores the sheets S having a predetermined size and type. Each sheet feeding cassette includes a pickup roller. Each pickup roller takes out the sheets S one by one from each sheet feeding cassette. Each pickup roller conveys the sheets taken out from each sheet feeding cassette to the printer unit 13.

The sheet discharging unit 15 conveys the sheet S received from the printer unit 13 to the sheet processing device 3.

Figure 2:
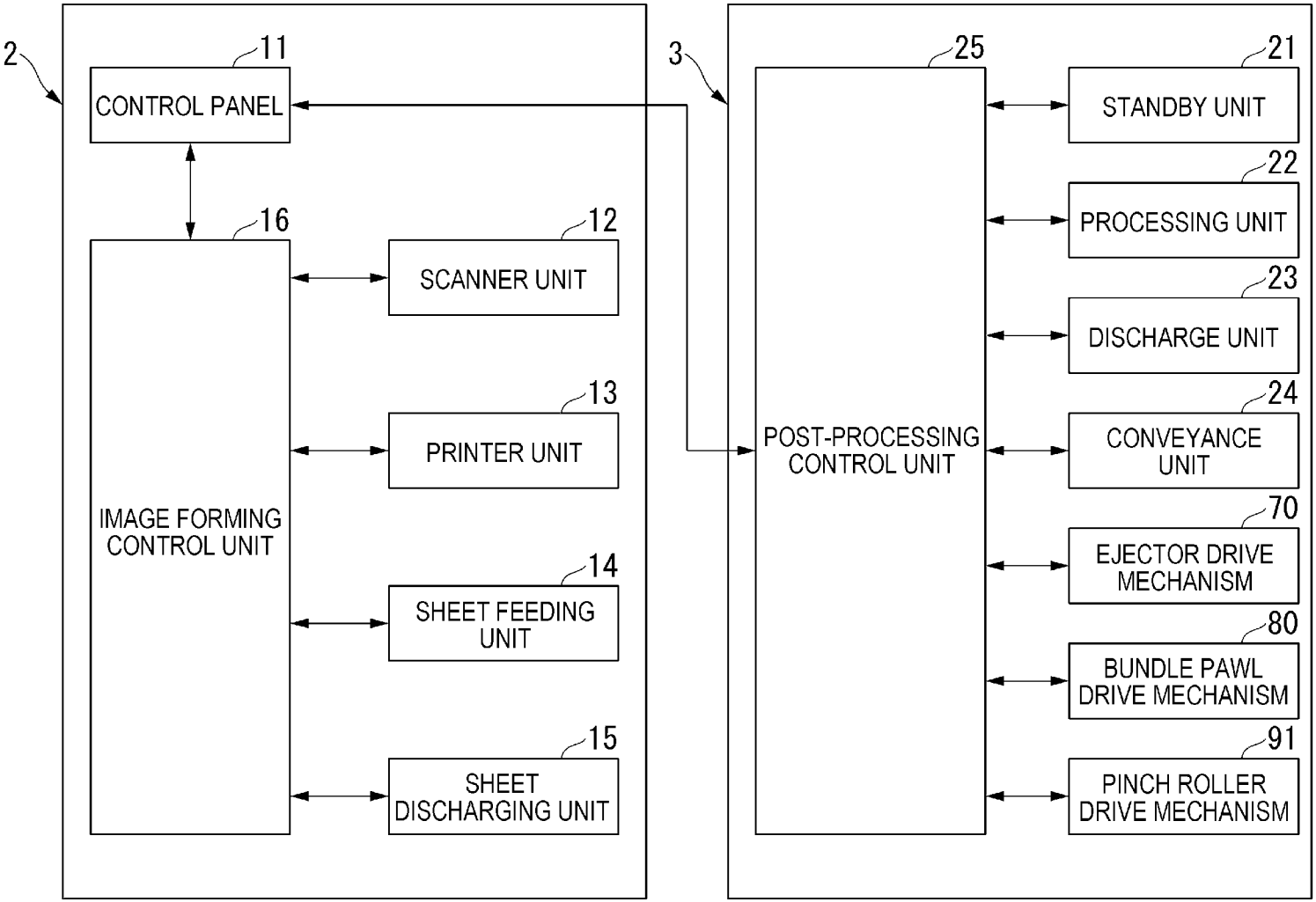
FIG. 2 is a block diagram illustrating an example of a functional configuration of an image forming device and a sheet processing device.

FIG. 2 is a block diagram illustrating an example of a functional configuration of the image forming device 2 and the sheet processing device 3 of the embodiment.

As illustrated in FIG. 2, the image forming control unit 16 controls the entire operation of the image forming device 2. The image forming control unit 16 controls the control panel 11, the scanner unit 12, the printer unit 13, the sheet feeding unit 14, and the sheet discharging unit 15. The image forming control unit 16 includes a control circuit which includes a CPU, a ROM, and a RAM.

As illustrated in FIG. 1, the sheet processing device 3 is disposed adjacent to the image forming device 2. The sheet processing device 3 performs the post processing designated through the control panel 11 on the sheet S which is conveyed from the image forming device 2. For example, the post processing includes the sorting and the stapling.

As illustrated in FIGS. 1 and 2, the sheet processing device 3 includes a standby unit 21, a processing unit 22, a discharge unit 23, a conveyance unit 24, a post-processing control unit 25, an ejector drive mechanism 70, a bundle pawl drive mechanism 80, and a pinch roller drive mechanism 91.

As illustrated in FIG. 1, the standby unit 21 temporally retains the sheet S which is received from the image forming device 2. For example, the standby unit 21 retains the plurality of succeeding sheets during a period when the processing unit 22 performs the post processing on the preceding sheet S. The standby unit 21 is disposed on the upper side in the vertical direction of the processing unit 22. The standby unit 21 overlaps the plurality of sheets S in the thickness direction and retains the sheets. The standby unit 21 drops the retained sheet S toward the processing unit 22 when the processing unit 22 enters a state of allowing the reception of the sheet S.

The processing unit 22 performs the post processing on the sheet S received from the standby unit 21. For example, the processing unit 22 performs the sorting to arrange and align the plurality of sheets S. For example, the processing unit 22 performs the stapling on the sheet bundle SS which is formed by arranging the plurality of sheets S. The processing unit 22 sends the post-processed sheet S to the discharge unit 23.

The discharge unit 23 supports the sheet S which is received from the standby unit 21 and the processing unit 22. The discharge unit 23 includes the fixed tray 23*a* and the movable tray 23*b*. For example, the fixed tray 23*a* is disposed on the upper portion of the sheet processing device 3. For example, the movable tray 23*b* is disposed on the side portion of the sheet processing device 3. The movable tray 23*b* moves in an upward and downward direction along the side portion of the sheet processing device 3. For example, the upward and downward direction is the vertical direction. The fixed tray 23*a* and the movable tray 23*b* support the sheet S received from the standby unit 21 and the processing unit 22.

The conveyance unit 24 includes a conveyance path 31, an inlet roller mechanism 32, and the outlet roller mechanism 33.

The conveyance path 31 is provided in the inner portion of the sheet processing device 3. The conveyance path 31 guides the sheet S received from the image forming device 2 toward the standby unit 21, the processing unit 22, or the discharge unit 23. The conveyance path 31 includes a first conveyance path 31*a*, and a second conveyance path 31*b* and a third conveyance path 31*c* which are branched from the first conveyance path 31*a*. The first conveyance path 31*a* guides the sheet S to the standby unit 21. The second conveyance path 31*b* guides the sheet S to the fixed tray 23*a* of the discharge unit 23. The third conveyance path 31*c* guides the sheet S to the processing unit 22.

The inlet roller mechanism 32 is disposed between the end of the conveyance path 31 on the upstream side in the sheet conveyance direction and the sheet discharging unit 15 of the image forming device 2. The inlet roller mechanism 32 conveys the sheet S received from the image forming device 2 to the conveyance path 31.

The outlet roller mechanism 33 is disposed between the end of the first conveyance path 31*a* on the downstream side in the sheet conveyance direction and the standby unit 21. The outlet roller mechanism 33 conveys the sheet S received from the first conveyance path 31*a* to the standby unit 21.

As illustrated in FIG. 2, the post-processing control unit 25 controls the entire operation of the sheet processing device 3. The post-processing control unit 25 controls the standby unit 21, the processing unit 22, the discharge unit 23, the conveyance unit 24, the ejector drive mechanism 70, the bundle pawl drive mechanism 80, and the pinch roller drive mechanism 91. The post-processing control unit 25 includes a control circuit which includes a CPU, a ROM, and a RAM.

Hereinafter, the detailed configuration of the sheet processing device 3 will be described.

Figure 3:
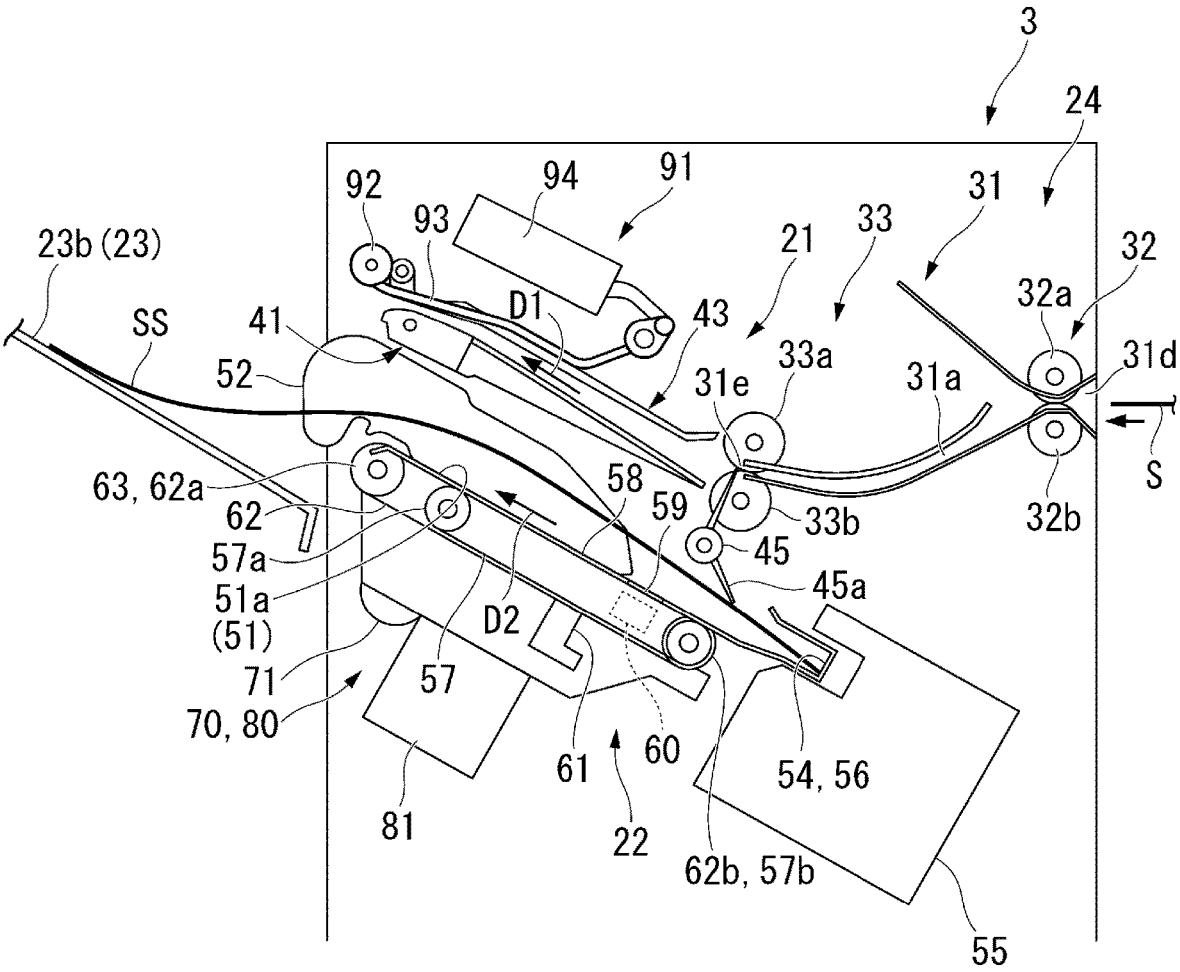
FIG. 3 is a side view schematically illustrating an example of a configuration of the sheet processing device.

FIG. 3 is a side view schematically illustrating an example of a configuration of the sheet processing device 3 of the embodiment.

As illustrated in FIG. 3, the conveyance unit 24 includes the conveyance path 31 where a sheet supply port 31*d* and a sheet discharge port 31*e* are formed. The sheet supply port 31*d* is formed in the end of the conveyance path 31 on the upstream side in the sheet conveyance direction to face the sheet discharging unit 15 of the image forming device 2. The sheet S discharged from the image forming device 2 is conveyed to the conveyance path 31 through the sheet supply port 31*d*. The sheet discharge port 31*e* is formed in the end of the first conveyance path 31*a* on the downstream side in the sheet conveyance direction to face the standby unit 21. The sheet S passing through the first conveyance path 31*a* is conveyed to the standby unit 21 through the sheet discharge port 31*e*.

As illustrated in FIGS. 1 and 3, the first conveyance path 31*a* guides the sheet S passing through the sheet supply port 31*d* to the standby unit 21 in the sort mode or the staple mode.

The second conveyance path 31*b* guides the sheet S to the fixed tray 23*a* when the fixed tray 23*a* of the discharge unit 23 is selected as a discharge destination of the sheet S in the non-sort mode.

The third conveyance path 31*c* directly guides the sheet S to the processing unit 22 when the movable tray 23*b* of the discharge unit 23 is selected as a discharge destination of the sheet S in the non-sort mode. When the third conveyance path 31*c* guides the sheet S directly to the processing unit 22, the sheet S may pass through the standby unit 21 without being retained in the standby unit 21.

As illustrated in FIG. 3, the inlet roller mechanism 32 of the conveyance unit 24 includes a first inlet roller 32*a* and a second inlet roller 32*b*. The first inlet roller 32*a* and the second inlet roller 32*b* face each other in the radial direction with the rotation axes parallel to each other. The first inlet roller 32*a* is a driven roller which is disposed on the upper surface side of the conveyance path 31. The second inlet roller 32*b* is a drive roller which is disposed on the lower surface side of the conveyance path 31. The first inlet roller 32*a* is driven and rotated by a force which is transferred directly from the second inlet roller 32*b* or through the sheet S. The first inlet roller 32*a* and the second inlet roller 32*b* interpose the sheet S in a nip portion therebetween from the both sides in the thickness direction. The first inlet roller 32*a* and the second inlet roller 32*b* convey the sheet S interposed in the nip portion to the downstream side in the sheet conveyance direction.

The outlet roller mechanism 33 of the conveyance unit 24 includes a first outlet roller 33*a* and a second outlet roller 33*b*. The first outlet roller 33*a* and the second outlet roller 33*b* face each other in the radial direction with the rotation axis parallel to each other. The first outlet roller 33*a* is a driven roller which is disposed on the upper surface side of the first conveyance path 31*a*. The second outlet roller 33*b* is a drive roller which is dispose on the lower surface side of the first conveyance path 31*a*. The first outlet roller 33*a* is driven and rotated by a force which is transferred directly from the second outlet roller 33*b* or through the sheet S. The first outlet roller 33*a* and the second outlet roller 33*b* interpose the sheet S in the nip portion therebetween from the both sides in the thickness direction. The first outlet roller 33*a* and the second outlet roller 33*b* convey the sheet S interposed in the nip portion to the downstream side in the sheet conveyance direction.

The standby unit 21 includes a standby tray 41, an assist guide 43, and a paddle portion 45. Further, the sheet conveyance direction in the standby unit 21 is a direction indicated by a first arrow D1 illustrated in FIG. 3. The direction of the first arrow D1 is an advancing direction of the sheet S from the first outlet roller 33*a* and the second outlet roller 33*b* toward the standby tray 41.

The end of the standby tray 41 on the upstream side in the sheet conveyance direction is disposed adjacent to the first outlet roller 33*a* and the second outlet roller 33*b*. The end of the standby tray 41 on the upstream side is disposed on the lower side in the vertical direction from the sheet discharge port 31*e* of the conveyance path 31. The standby tray 41 is inclined with respect to the horizontal direction such that the downstream side gradually goes up to the upper side from the upstream side in the vertical direction as it goes from the upstream side to the downstream side in the sheet conveyance direction. The standby tray 41 overlaps the plurality of sheets S in the thickness direction and retains the sheets S during a period when the processing unit 22 performs the post processing on the preceding sheet S.

The standby tray 41 includes a pair of tray members which move in the opposite direction to each other in a sheet width direction. The sheet width direction is a direction perpendicular to the sheet conveyance direction and parallel to the surface of the sheet S. The pair of tray members approach each other to support the sheet S when the sheet S is retained in the standby tray 41. The pair of tray members move in a direction separating from each other to release the supporting of the sheet S when the sheet S is moved from the standby tray 41 toward the processing unit 22. The pair of tray members drops the sheet S toward the processing unit 22 by being separated from each other to release the supporting the sheet S.

The assist guide 43 is disposed on the upper side in the vertical direction of the standby tray 41. For example, the length in the sheet conveyance direction of the assist guide 43 is formed equal to the length in the sheet conveyance direction of the standby tray 41. The assist guide 43 pushes the sheet S toward the processing unit 22 when the sheet S is moved from the standby tray 41 toward the processing unit 22. The assist guide 43 includes a pivotal shaft parallel to the sheet width direction at the end on the downstream side in the sheet conveyance direction. The assist guide 43 swings the end on the upstream side in the sheet conveyance direction about the pivotal shaft. The assist guide 43 swings the end on the upstream side in the sheet conveyance direction to push the sheet S when the sheet S is pushed toward the processing unit 22.

The paddle portion 45 is disposed between the end of the standby tray 41 on the upstream side and the processing unit 22. The paddle portion 45 includes a rotation shaft parallel to the sheet width direction and a paddle 45*a* which rotates about the rotation shaft. For example, the paddle 45*a* is formed of an elastic material such as rubber. The paddle 45*a* rotates about the rotation shaft in a state of being in contact with the sheet S when the sheet S is moved from the standby tray 41 toward the processing unit 22. For example, the paddle 45*a* rotates in the counterclockwise direction in FIG. 3. The paddle 45*a* moves the sheet S dropped from the standby tray 41 to the processing unit 22 toward the end of the processing unit 22 on the upstream side in the sheet conveyance direction. The paddle 45*a* brings the sheet S to come into contact with the end of the processing unit 22 on the upstream side in the sheet conveyance direction, and adjusts the position of the rear end of the sheet S in the sheet conveyance direction. The paddle 45*a* aligns the position of the sheet S in the sheet conveyance direction in the processing unit 22 (so-called vertical alignment). The paddle portion 45 forms a vertical alignment device which performs the vertical alignment on the sheet S in the sheet conveyance direction together with the conveyance roller 63 and a rear end stopper 54 of the processing unit 22 which is described below.

Figure 4:
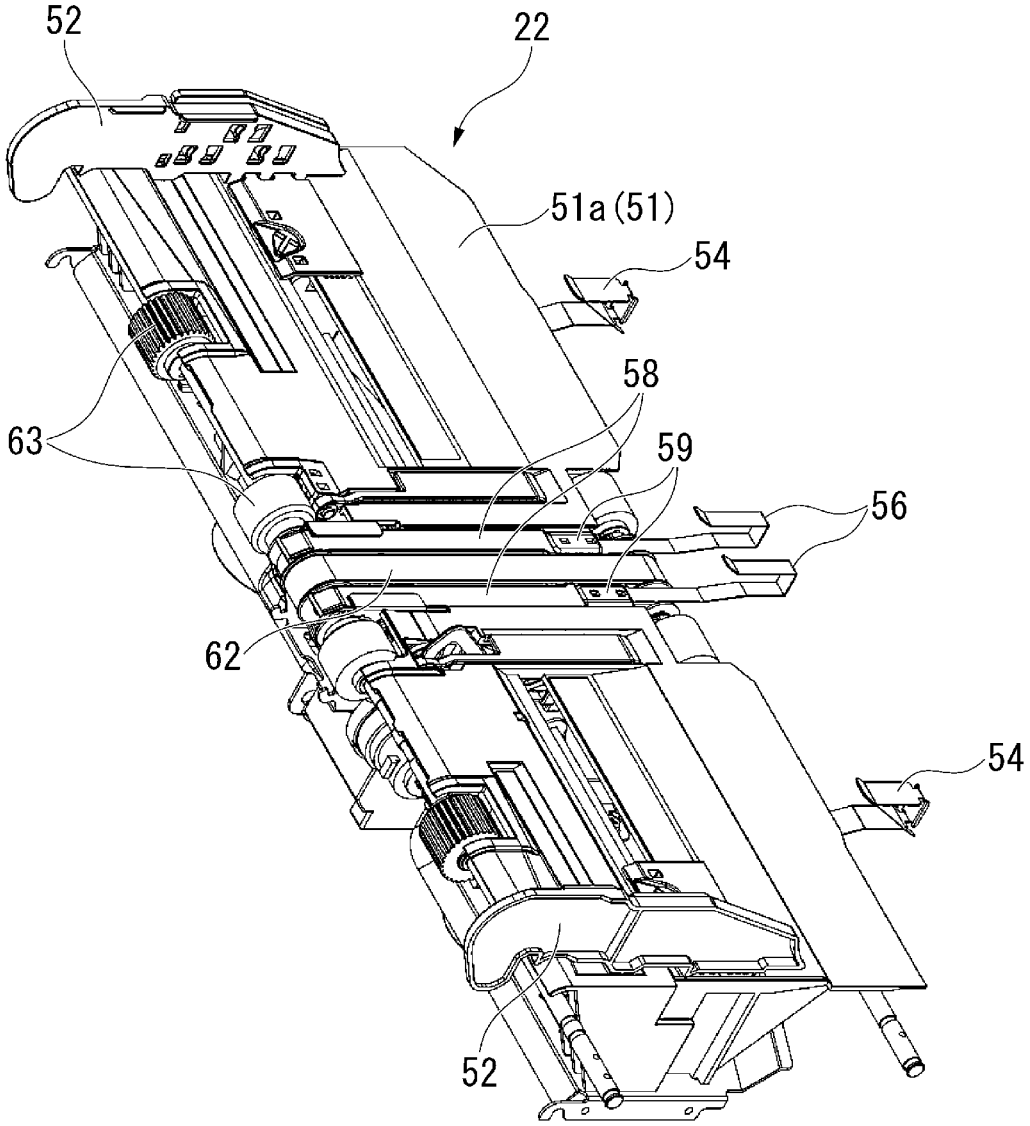
FIG. 4 is a perspective view illustrating a part of a processing unit.

FIG. 4 is a perspective view illustrating a part of the processing unit 22 of the embodiment.

As illustrated in FIGS. 3 and 4, the processing unit 22 includes a processing tray 51, a pair of horizontal alignment plates 52, a pair of rear end stoppers 54, a stapler 55, a pair of ejectors 56, a pair of ejector belts 57, a pair of thrusters 58 (guide member), a bundle pawl 61, a bundle pawl belt 62, an ejector sensor 60 (detection device), and the conveyance roller 63. Further, the sheet conveyance direction in the processing unit 22 is a direction indicated by a second arrow D2 illustrated in FIG. 3. The direction of the second arrow D2 is a discharging direction of the sheet S from the processing tray 51. Hereinafter, if not otherwise specified, the sheet conveyance direction is the sheet conveyance direction in the processing unit 22.

The processing tray 51 is disposed on the lower side in the vertical direction of the standby tray 41. The end of the processing tray 51 on at least the upstream side in the sheet conveyance direction is provided in the inner portion of the sheet processing device 3. The processing tray 51 is inclined with respect to the horizontal direction such that the downstream side gradually goes up to the upper side in the vertical direction from the upstream side as it goes from the upstream side to the downstream side in the sheet conveyance direction. For example, the processing tray 51 is disposed in parallel to the standby tray 41. The processing tray 51 includes a conveyance surface 51*a* where the sheet S is mounted. The conveyance surface 51*a* supports the sheet S.

The pair of horizontal alignment plates 52 is disposed to be separated in the sheet width direction from the conveyance surface 51*a* of the processing tray 51. The pair of horizontal alignment plates 52 moves in the opposite direction to each other in the sheet width direction. The pair of horizontal alignment plates 52 is disposed adjacent to each other to interpose the sheet S from the both sides in the sheet width direction so as to adjust the positions of both ends of the sheet S in the width direction. The pair of horizontal alignment plates 52 aligns the positions of the sheet S in the width direction (so-called horizontal alignment). The pair of horizontal alignment plates 52 moves in a direction of being separated from each other when the interposing of the sheet S is released.

The pair of rear end stoppers 54 is disposed at the end of the processing tray 51 on the upstream side in the sheet conveyance direction. The pair of rear end stoppers 54 is disposed to be separated from each other in the sheet width direction. For example, the shape of the rear end stopper 54 is formed in a hook shape. The pair of rear end stoppers 54 can come into contact with the end of the sheet S which is mounted in the processing tray 51 on the upstream side in the sheet conveyance direction.

As illustrated in FIG. 3, the stapler 55 is a binding unit which performs the stapling on the sheet bundle SS which is formed by arranging a plurality of sheets S. The stapler 55 is disposed on the upstream side from the end of the processing tray 51 on the upstream side in the sheet conveyance direction. For example, the stapler 55 fastens the rear end of the plurality of sheets S which come into contact with the rear end stopper 54 at the positions of the rear ends to be arranged. The stapler 55 performs the stapling on the sheet bundle SS if the staple mode is selected. For example, the stapler 55 pierces a stable at a reference position of the sheet bundle SS which comes into contact with the rear end stopper 54.

As illustrated in FIGS. 3 and 4, the pair of ejectors 56 is disposed at the end of the processing tray 51 on the upstream side in the sheet conveyance direction. The pair of ejectors 56 is disposed to be separated from each other in the sheet width direction. The pair of ejectors 56 is disposed between the pair of rear end stoppers 54 in the sheet width direction. An ejector 56 is overlapped with the rear end stopper 54 when viewed from the sheet width direction. For example, the shape of the ejector 56 is formed in a hook shape. The pair of ejectors 56 can come into contact with the end of the sheet S which is mounted in the processing tray 51 on the upstream side in the sheet conveyance direction.

Figure 5:
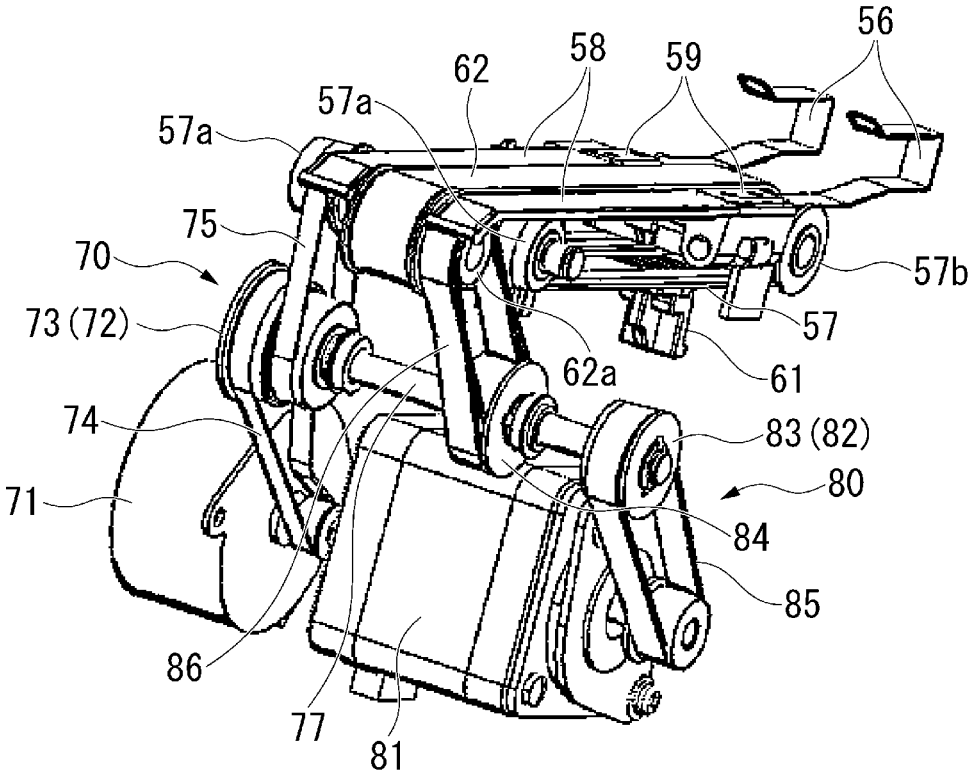
FIG. 5 is a perspective view illustrating a part of the processing unit.

FIG. 5 is a perspective view illustrating a part of the processing unit 22 of the embodiment.

As illustrated in FIG. 5, the ejector 56 is fixed to an ejector belt 57. For example, the ejector 56 is nipped by a clip 59 together with the ejector belt 57 so as to be fixed to the ejector belt 57. The ejector belt 57 is provided one by one to each of the pair of ejectors 56. The pair of ejector belts 57 is respectively suspended on a first belt roller 57*a* and a second belt roller 57*b* which are disposed to be separated in the sheet conveyance direction.

Each of the first belt roller 57*a* and the second belt roller 57*b* is provided by pair corresponding to the pair of ejector belts 57. The pair of first belt rollers 57*a* is coaxially provided. The pair of first belt rollers 57*a* is fixed to each other to rotate in synchronization. The pair of second belt rollers 57*b* is coaxially provided. The pair of second belt rollers 57*b* is fixed to each other to rotate in synchronization. The first belt roller 57*a* is disposed on the downstream side in the sheet conveyance direction from the second belt roller 57*b*. The first belt roller 57*a* is a roller which drives the ejector belt 57. The second belt roller 57*b* is a driven roller. The second belt roller 57*b* is driven and rotated by a force which is transferred from the first belt roller 57*a* through the ejector belt 57. The first belt roller 57*a* which is one of the pair of first belt rollers 57*a* is formed by a two-stage pulley where a second transferring belt 75 is wound.

Figure 6:
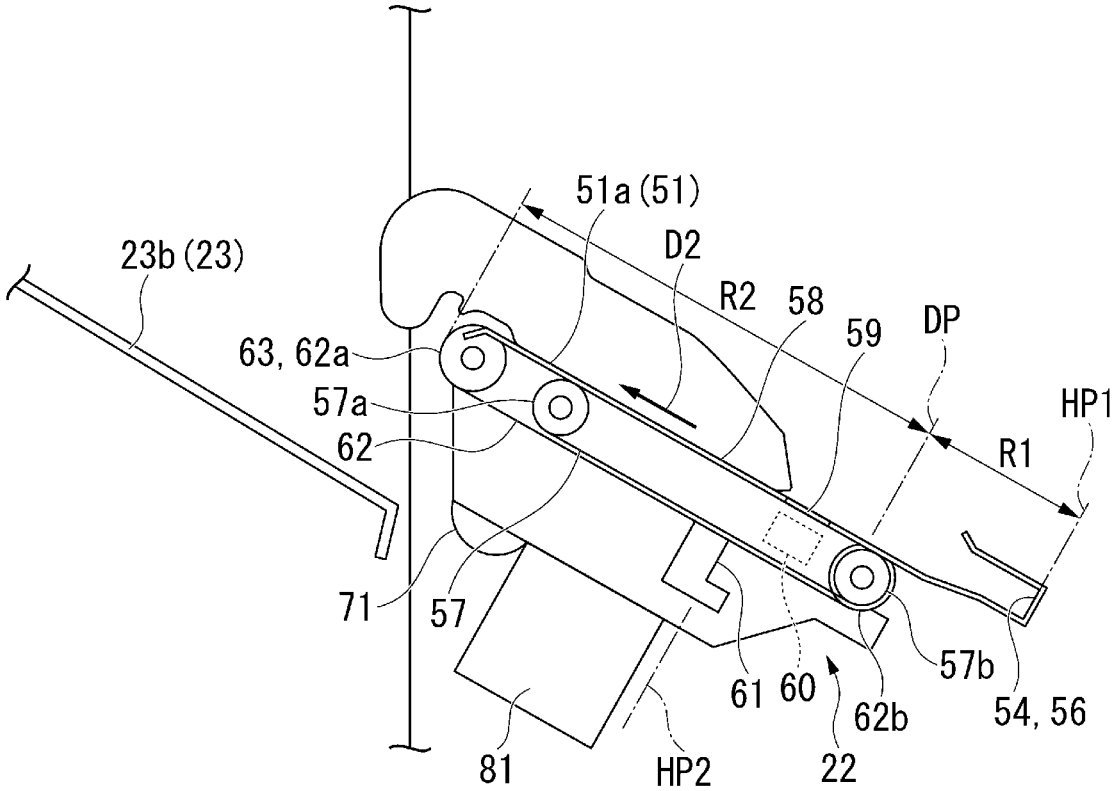
FIG. 6 is a side view schematically illustrating the processing unit.

FIG. 6 is a side view schematically illustrating the processing unit 22 of the embodiment.

As illustrated in FIG. 6, the ejector 56 moves along the sheet conveyance direction as the ejector belt 57 rotates. The ejector 56 is on standby at a home position HP1. The home position HP1 of the ejector 56 is a position where the ejector 56 is overlapped with the rear end stopper 54 when viewed from the sheet width direction. For example, the ejector 56 is restricted in movement to the upstream side in the sheet conveyance direction at the home position HP1 due to the contact between the clip 59 and the processing tray 51. In other words, the ejector 56 is located at the home position HP1 by bringing the clip 59 into contact with the processing tray 51. Further, the ejector 56 may come into contact with a member fixed to the processing tray 51 or the processing tray 51 to restrict the movement. Whether the ejector 56 exists at the home position HP1 is detected by the ejector sensor 60.

The ejector 56 comes into contact with the end of the sheet S on the upstream side in the sheet conveyance direction on the processing tray 51 (see FIG. 3). The ejector 56 moves from the home position HP1 toward the downstream side of the sheet conveyance direction. The ejector 56 moves along the sheet conveyance direction while coming into contact with the sheet S in a first region R1 in the sheet conveyance direction. In the first region R1, the home position HP1 of the ejector 56 is the end on the upstream side in the sheet conveyance direction. In the first region R1, a delivery position DP described below becomes the end on the downstream side in the sheet conveyance direction. The ejector 56 moves while coming into contact with the sheet S, and moves the sheet S to the sheet conveyance direction. The ejector 56 moves the end of the sheet S on the upstream side in the sheet conveyance direction up to the delivery position DP where the sheet S is delivered to the bundle pawl 61. After moving the sheet S up to the delivery position DP, the ejector 56 moves the sheet S from the delivery position DP toward the upstream side in the sheet conveyance direction up to the home position HP1.

The ejector sensor 60 detects the position of the ejector 56. For example, the ejector sensor 60 outputs a detection signal to the post-processing control unit when the ejector 56 exists at the home position HP1. For example, the ejector sensor 60 is an optical sensor. For example, the ejector sensor detects the presence/absence of the clip 59 at a predetermined position to detect the position of the ejector 56.

As illustrated in FIG. 5, the pair of thrusters 58 is disposed along the conveyance surface 51*a* of the processing tray 51. The pair of thrusters 58 is disposed on the downstream side in the sheet conveyance direction from the ejector 56. For example, the thruster 58 is formed in a plate shape. The pair of thrusters 58 is fixed to the ejector belt 57. For example, the pair of thrusters 58 is fixed to the ejector belt 57 together with the ejector 56 by being nipped to the clip 59. The pair of thrusters 58 moves along the sheet conveyance direction together with the ejector 56.

As illustrated in FIG. 6, the pair of thrusters 58 is disposed on the upstream side in the sheet conveyance direction from the conveyance roller 63 at the reference position. The reference position of the thruster 58 is a position when the ejector 56 exists at the home position HP1. When the thruster 58 is moved from the reference position to the sheet conveyance direction, the tip end in the sheet conveyance direction protrudes toward the downstream side in the sheet conveyance direction from the conveyance roller 63 (see FIG. 8). The pair of thrusters 58 protrudes toward the downstream side in the sheet conveyance direction from the conveyance roller 63 such that the conveyance surface 51*a* of the processing tray 51 is extended toward the downstream side in the sheet conveyance direction. The pair of thrusters 58 comes into contact with the lower surface of the sheet S which protrudes toward the downstream side in the sheet conveyance direction from the conveyance roller 63 to support the sheet S.

As illustrated in FIG. 5, the bundle pawl 61 is an extrusion member which pushes and moves the sheet S of the processing tray 51 toward the downstream side in the sheet conveyance direction. The bundle pawl 61 is fixed to the bundle pawl belt 62. For example, the shape of the bundle pawl 61 is formed in a hook shape. The bundle pawl belt 62 is suspended on a third belt roller 62*a* and a fourth belt roller 62*b* which are disposed to be separated in the sheet conveyance direction (see FIG. 3). For example, the fourth belt roller 62*b* is disposed coaxially with the second belt roller 57*b*. The third belt roller 62*a* is disposed on the downstream side in the sheet conveyance direction from the fourth belt roller 62*b*. The third belt roller 62*a* is a drive roller. The third belt roller 62*a* coaxially drives the bundle pawl belt 62. The fourth belt roller 62*b* is a driven roller. The fourth belt roller 62*b* is driven and rotated by a force which is transferred from the third belt roller 62*a* through the bundle pawl belt 62.

As illustrated in FIG. 6, the bundle pawl 61 moves along the rotation of the bundle pawl belt 62. The bundle pawl 61 is on standby at a home position HP2. The home position HP2 of the bundle pawl 61 is located in front of the fourth belt roller 62*b* in the opposite direction to the sheet conveyance direction in the lower surface side of the processing tray 51. Whether the bundle pawl 61 exists at the home position HP2 is detected by a bundle pawl sensor (not illustrated).

The bundle pawl 61 comes into contact with the end of the sheet S which is mounted in the processing tray 51 on the upstream side in the sheet conveyance direction on the upper surface side of the processing tray 51. The upper surface side of the processing tray 51 is a side of the conveyance surface 51*a*. The bundle pawl 61 moves along the sheet conveyance direction while coming into contact with the sheet S in a second region R2 on the downstream side from the first region R1 in the sheet conveyance direction. In the second region R2, the delivery position DP becomes the end on the upstream side in the sheet conveyance direction. The bundle pawl 61 moves while coming into contact with the sheet S to convey the sheet S to be extruded from the upstream side toward the downstream side in the sheet conveyance direction.

For example, the bundle pawl 61 moves from the home position HP2 toward the fourth belt roller 62*b* on the lower surface side of the processing tray 51 as the bundle pawl belt 62 rotates forward. The forward rotation of the bundle pawl belt 62 is a rotation in the counterclockwise direction in FIG. 6. The bundle pawl 61 moves from the lower surface side to the upper surface side of the processing tray 51 along the outer periphery of the fourth belt roller 62*b*. The bundle pawl 61 receives the sheet S from the ejector 56 at the delivery position DP on the upper surface side of the processing tray 51. The bundle pawl 61 moves along the sheet conveyance direction while coming into contact with the end of the sheet S on the upstream side in the sheet conveyance direction in the second region R2 of the sheet conveyance direction. The bundle pawl 61 moves toward the lower surface side of the processing tray 51 along the outer periphery of the third belt roller 62*a* while conveying the sheet S. The bundle pawl 61 extrudes and discharges the sheet S to the downstream side at the end in the second region R2 on the downstream side. In other words, the end in the second region R2 in the sheet conveyance direction on the downstream side is a position where the bundle pawl 61 moves from the upper surface side to the lower surface side of the processing tray 51 when conveying the sheet S.

For example, after discharging the sheet S, the bundle pawl 61 moves to the upstream side in the sheet conveyance direction on the upper surface side of the processing tray 51 as the bundle pawl belt 62 rotates reversely. The bundle pawl 61 moves from the upper surface side to the lower surface side of the processing tray 51 along the outer periphery of the fourth belt roller 62*b* to return to the home position HP2.

As illustrated in FIG. 5, the ejector belt 57, the first belt roller 57*a*, and the second belt roller 57*b* form the ejector drive mechanism 70. The ejector drive mechanism 70 drives the ejector 56 and the thruster 58. The ejector drive mechanism 70 includes a first motor 71 and a first power transmission unit 72.

The first motor 71 is a driving source of the ejector 56 and the thruster 58. For example, the first motor 71 is a stepping motor. The first motor 71 is disposed on the lower side of the one first belt roller 57*a*. The first motor 71 is controlled by the post-processing control unit 25.

The first power transmission unit 72 transfers power from the first motor 71 to the ejector 56. The first power transmission unit 72 is formed by a rotor and a belt which is suspended on the rotor. The first power transmission unit 72 includes the ejector belt 57, the first belt roller 57*a*, and the second belt roller 57*b* described above. Further, the first power transmission unit 72 includes a first pulley 73 (first rotor), a first transferring belt 74, and the second transferring belt 75.

The first pulley 73 is disposed between an output shaft of the first motor 71 and the one first belt roller 57*a*. The first pulley 73 is formed as a two-state pulley. The first pulley 73 is supported to a shaft 77. The shaft 77 extends in the sheet width direction. The shaft 77 is provided to be rotatably with respect to the processing tray 51. A bearing is interposed between the first pulley 73 and the shaft 77. For example, the bearing is a rolling bearing such as a ball bearing. With this configuration, the first pulley 73 is relatively rotatable with respect to the shaft 77.

The first transferring belt 74 is suspended on the output shaft of the first motor 71 and the first pulley 73. The first transferring belt 74 is rotated by a driving force of the first motor 71. The first transferring belt 74 transfers the driving force of the first motor 71 to the first pulley 73.

The second transferring belt 75 is suspended on the first pulley 73 and the one first belt roller 57*a*. The second transferring belt 75 is rotated by a rotation force of the first pulley 73. The second transferring belt 75 transfers the rotation force of the first pulley 73 to the one first belt roller 57*a*.

The one first belt roller 57*a* rotates together with the other first belt roller 57*a*. When the pair of first belt rollers 57*a* rotates, the pair of ejector belts 57 rotates. With this configuration, the first motor 71 drives the ejector 56.

The bundle pawl belt 62, the third belt roller 62*a*, and the fourth belt roller 62*b* (see FIG. 6) form the bundle pawl drive mechanism 80. The bundle pawl drive mechanism 80 drives the bundle pawl 61. The bundle pawl drive mechanism 80 includes a second motor 81 and a second power transmission unit 82.

The second motor 81 is a driving source of the bundle pawl 61. For example, the second motor 81 is a stepping motor. For example, the second motor 81 is arranged in the sheet width direction in the first motor 71 on the lower side of the processing tray 51. The second motor 81 is controlled by the post-processing control unit 25.

The second power transmission unit 82 transfers power from the second motor 81 to the bundle pawl 61. The second power transmission unit 82 is configured by a rotor and a belt which is suspended on the rotor. The second power transmission unit 82 includes the bundle pawl belt 62, the third belt roller 62*a*, and the fourth belt roller 62*b* described above. Further, the second power transmission unit 82 includes a second pulley 83 (second rotor), a third pulley 84 (second rotor), a third transferring belt 85, and a fourth transferring belt 86.

The second pulley 83 is disposed between an output shaft of the second motor 81 and the third belt roller 62*a* when viewed from the sheet width direction. The second pulley 83 is disposed coaxially with the first pulley 73 of the ejector drive mechanism 70. The second pulley 83 is fixedly supported by the shaft 77. The second pulley 83 is configured to be rotatable together with the shaft 77.

The third pulley 84 is disposed coaxially with the second pulley 83. The third pulley 84 is fixedly supported by the shaft 77. The third pulley 84 is configured to be rotatable together with the shaft 77 and the second pulley 83. In other words, the second pulley 83 and the third pulley 84 are relatively rotatable with respect to the first pulley 73 of the ejector drive mechanism 70.

The third transferring belt 85 is suspended on the output shaft of the second motor 81 and the second pulley 83. The third transferring belt 85 is rotated by a driving force of the second motor 81. The third transferring belt 85 transfers the driving force of the second motor 81 to the second pulley 83, the shaft 77, and the third pulley 84.

The fourth transferring belt 86 is suspended on the third pulley 84 and the third belt roller 62*a*. The fourth transferring belt 86 is rotated by a rotation force of the third pulley 84. The fourth transferring belt 86 transfers the rotation force of the third pulley 84 to the third belt roller 62*a*.

When the third belt roller 62*a* rotates, the bundle pawl belt 62 rotates. With this configuration, the second motor 81 drives the bundle pawl 61.

As illustrated in FIG. 3, the conveyance roller 63 is disposed at the end of the processing tray 51 in the sheet conveyance direction on the downstream side. For example, the conveyance roller 63 is disposed to be overlapped with the third belt roller 62*a* when viewed from the sheet width direction. The conveyance roller 63 adjusts the position of the end of the sheet S which is mounted in the processing tray 51 on the upstream side in the sheet conveyance direction. The conveyance roller 63 serves as a vertical alignment roller which aligns the position in the sheet conveyance direction of the sheet S. The conveyance roller 63 forms a vertical alignment device which aligns the sheet S together with the paddle portion 45 and the rear end stopper 54. For example, the conveyance roller 63 rotates in the clockwise direction in FIG. 3 to convey the sheet S mounted in the processing tray 51 toward the rear end stopper 54. The conveyance roller 63 brings the end on of the sheet S the upstream side in the sheet conveyance direction into contact with the rear end stopper 54 in cooperation with the paddle portion 45 so as to align the sheet S.

The conveyance roller 63 conveys the sheet S mounted in the processing tray 51 toward the movable tray 23*b* of the discharge unit 23. For example, the conveyance roller 63 rotates in the counterclockwise direction in FIG. 3 to convey the sheet S to the downstream side in the sheet conveyance direction. The conveyance roller 63 comes into contact with the sheet S mounted in the processing tray 51 toward the lower side so as to apply the driving force. For example, the conveyance roller 63 nips the sheet S in the nip portion formed with respect to a pinch roller 92 which is located at a pivotal position, and applies the driving force to the sheet S.

The pinch roller drive mechanism 91 includes a support arm 93 which supports the pinch roller 92, and a solenoid 94 which drives the support arm 93.

The pinch roller 92 is a driven roller which does not include the driving source. The pinch roller 92 moves between a standby position on the upper side in the vertical direction from the standby tray 41 and the pivotal position closed to the conveyance roller 63 on the lower side in the vertical direction from the standby position. The pinch roller 92 and the conveyance roller 63 at the pivotal position are disposed parallel to each other with respect to the rotation axis so as to face each other in the radial direction. The pinch roller 92 nips the sheet S at the pivotal position in a gap with the conveyance roller 63, and is driven and rotated by a rotating and driving force of the conveyance roller 63 which is transferred through the sheet S.

The support arm 93 supports the pinch roller 92 at a tip end. The support arm 93 includes a pivotal shaft parallel in the sheet width direction at a base end. The support arm 93 rotates about the pivotal shaft to swing the pinch roller 92 between the standby position and the pivotal position.

The solenoid 94 is connected to the base end of the support arm 93. For example, the solenoid 94 is a latching-type solenoid. The solenoid 94 swings the pinch roller 92 through the support arm 93 when a plunger protrudes. The solenoid 94 moves the pinch roller 92 to the standby position separated from the conveyance roller 63 as the plunger protrudes. The solenoid 94 swings the pinch roller 92 to the lower side through the support arm 93 when the plunger recedes. The solenoid 94 swings the pinch roller 92 to the pivotal position closed to the conveyance roller 63 as the plunger recedes.

The post-processing control unit 25 performs an initial process. For example, the initial process is a process which is performed when the sheet processing device 3 is energized. As one of the initial processes, there is a current adjustment of the first motor 71. The current adjustment of the first motor 71 is a process of detecting the magnitude of the current necessary for driving the first motor 71. The post-processing control unit 25 determines a driving current and a holding current by the current adjustment of the first motor 71. The driving current is a current flowing to the first motor 71 when the ejector 56 is moved. The holding current is a current flowing to the first motor 71 when the output shaft of the first motor 71 is fixed. The holding current is a current which is smaller than the driving current, and larger than "0". For example, the post-processing control unit 25 causes a predetermined current to flow to the first motor 71 to switch a signal from the ejector sensor 60 so as to move the ejector 56 from the upstream side to the downstream side. Thereafter, the post-processing control unit 25 confirms whether the ejector sensor 60 detects the ejector 56 when the ejector 56 is moves from the downstream side to the upstream side by the same current value. When the ejector sensor 60 does not detect the ejector 56, the post-processing control unit 25 changes the current value and retries the above process for example. When the ejector sensor 60 correctly detects the ejector 56, the post-processing control unit 25 sets the current value at that time as a basic current value, and sets the holding current and the driving current on the basis of the basic current value. The holding current is a value obtained by multiplying a predetermined coefficient for the holding current to the basic current value. The driving current is a value obtained by multiplying a predetermined coefficient for the driving current to the basic current value. A relation between the coefficient for the holding current and the coefficient for the driving current satisfies a relation of Coefficient for the holding current<Coefficient for the driving current.

The post-processing control unit 25 performs a binding position adjustment process when the stapling is performed by the stapler 55. The binding position adjustment process is a process of adjusting a position where the stapling is performed on the sheet bundle SS. The position where the stapling is performed is a position where the staple pierces. For example, the binding position adjustment process includes two types.

A first binding position adjustment process will be described.

The post-processing control unit 25 drives the first motor 71 before the sheet S is conveyed to the processing tray 51. The post-processing control unit 25 moves the ejector 56 in the sheet conveyance direction from the home position HP1 as the staple pierces the sheet bundle SS. Then, the ejector 56 is located on the downstream side in the sheet conveyance direction from the rear end stopper 54. The post-processing control unit 25 conveys the sheet S to the processing tray 51, and brings the sheet S to come into contact with the ejector 56 by the conveyance roller 63 and the paddle portion 45. The sheet bundle SS is aligned on the downstream side in the sheet conveyance direction from the rear end stopper 54. With this configuration, the position of the sheet bundle SS with respect to the stapler 55 is changed, and the position where the staple pierces the sheet bundle SS is adjusted. In this process, the ejector 56 is on standby on the downstream side of the rear end stopper 54 in advance. Therefore, a total processing time can be shortened.

A second binding position adjustment process will be described.

The post-processing control unit 25 drives the first motor 71 after the vertical alignment and the horizontal alignment of the sheet bundle SS are completed by the conveyance roller 63 and the paddle portion 45. The post-processing control unit 25 moves the ejector 56 from the home position HP1 to the downstream side in the sheet conveyance direction. The ejector 56 moves the sheet bundle SS in the sheet conveyance direction which comes into contact with the rear end stopper 54. With this configuration, the position of the sheet bundle SS with respect to the stapler 55 is changed, and the position where the staple pierces the sheet bundle SS is adjusted. In this process, the rear end of the sheet bundle SS is arranged at four points by the ejector 56 and the rear end stopper 54. Therefore, the alignment performance is increased.

The post-processing control unit 25 performs a discharging of the sheet S or the sheet bundle SS which is subjected to the post processing by the processing tray 51. The discharging is a process of discharging the sheet S or the sheet bundle SS by the ejector 56 and the bundle pawl 61.

Further, in the discharging, the conveyance roller 63 and the pinch roller 92 may be performed together according to the sheet size and the number of sheets.

Hereinafter, the discharging will be described in detail with reference to FIGS. 7 to 12. Further, the following description will be given about a case where the sheet bundle SS is discharged. However, the same is applied to the case where one sheet S is discharged.

Figure 7:
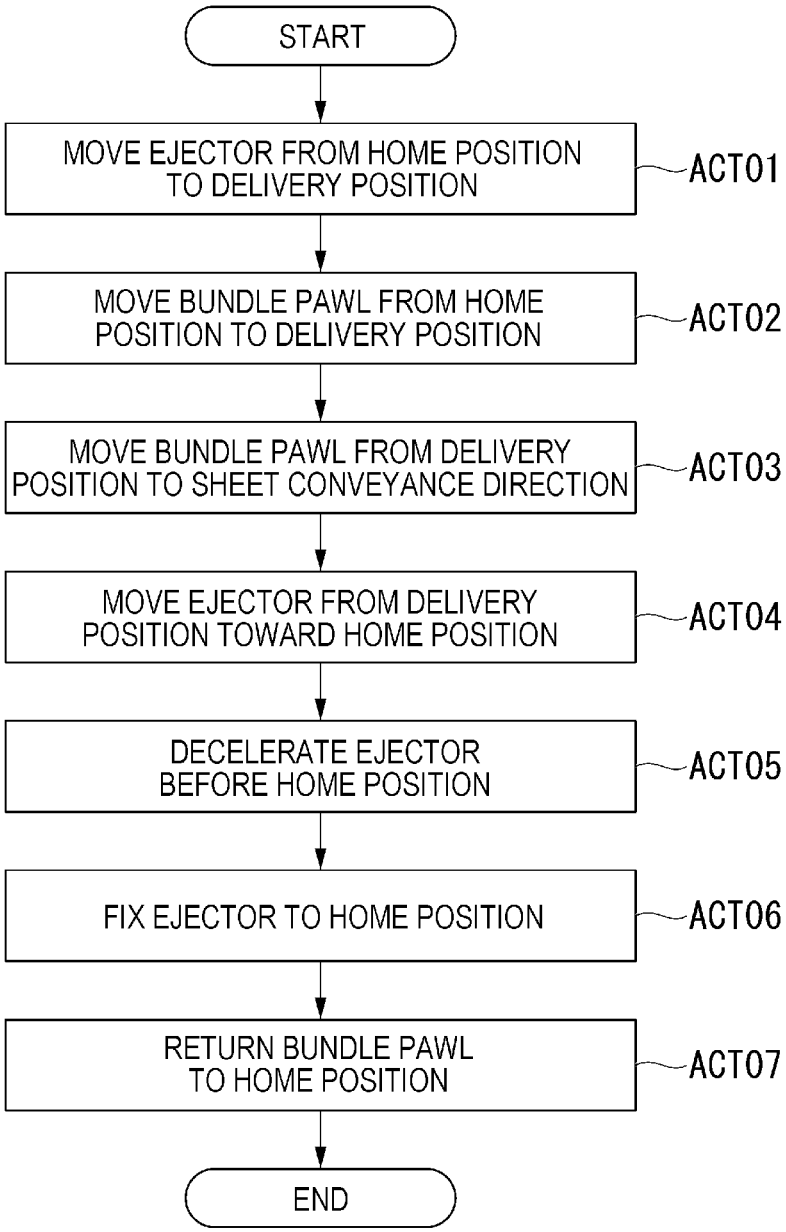
FIG. 7 is a flowchart illustrating a discharging flow in the sheet processing device.

FIG. 7 is a flowchart illustrating a discharging flow in the sheet processing device 3 of the embodiment. FIGS. 8 to 12 are side views illustrating an operation state in the discharging of the sheet processing device 3 of the embodiment. Further, in FIGS. 8 to 12, the rear end stopper 54 is not illustrated.

Figure 8:
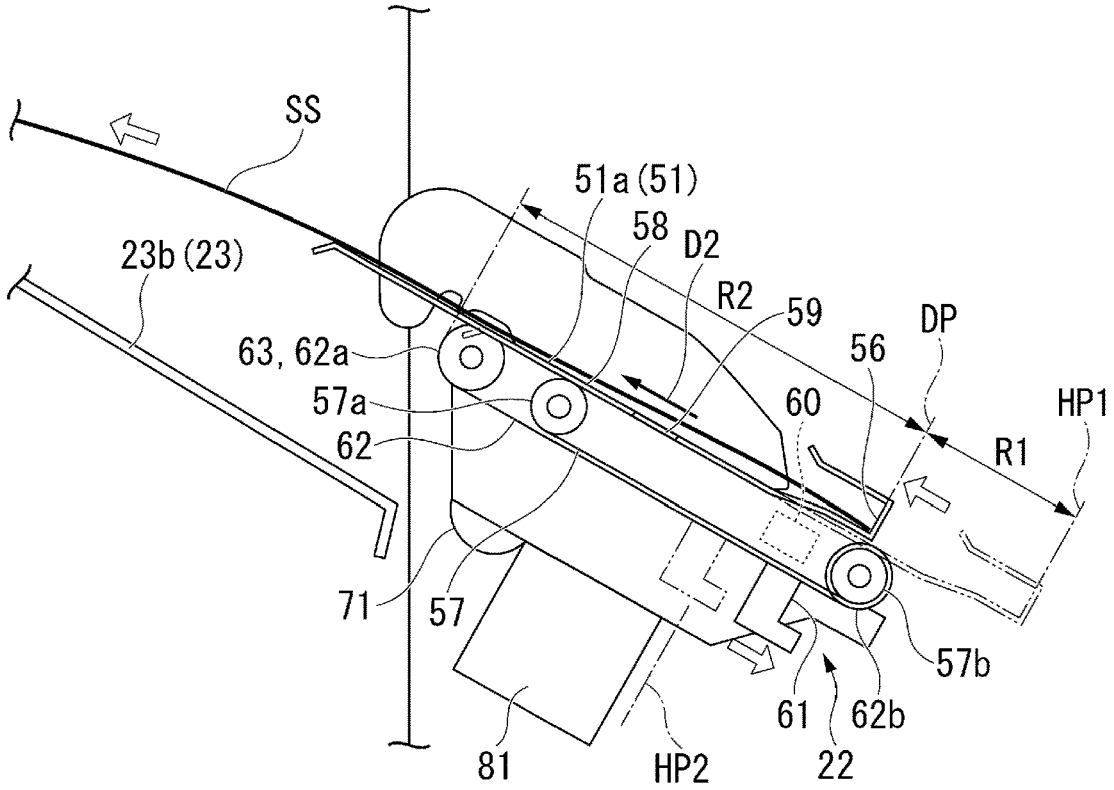
FIG. 8 is a side view illustrating an operation state in the discharging of the sheet processing device.

First, the post-processing control unit 25 moves the ejector 56 from the home position HP1 up to the delivery position DP (ACT 01). As illustrated in FIG. 8, the post-processing control unit 25 causes the driving current to flow to the first motor 71, and moves the ejector 56 and the thruster 58 by the first motor 71. The ejector 56 conveys the sheet bundle SS in the sheet conveyance direction. The thruster 58 causes the tip end in the sheet conveyance direction to protrude toward the downstream side in the sheet conveyance direction from the conveyance roller 63.

Figure 9:
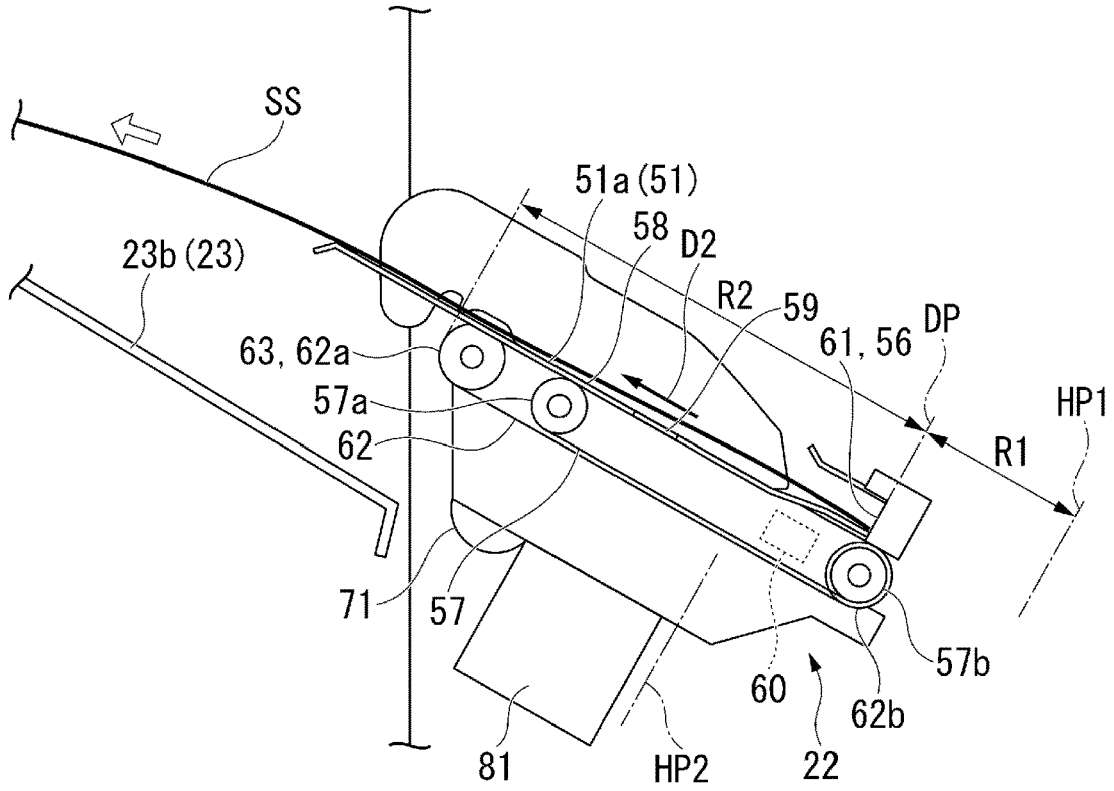
FIG. 9 is a side view illustrating an operation state in the discharging of the sheet processing device.

Next, the post-processing control unit 25 moves the bundle pawl 61 from the home position HP2 on the lower surface side of the processing tray 51 up to the delivery position DP on the upper surface side of the processing tray 51 (ACT 02). As illustrated in FIG. 8, the post-processing control unit 25 moves the bundle pawl 61 by the second motor 81. With this configuration, as illustrated in FIG. 9, the bundle pawl 61 comes into contact with the end of the sheet bundle SS on the upstream side in the sheet conveyance direction. Further, the movement of the bundle pawl 61 may start before the ejector 56 reaches the delivery position DP. In addition, the movement of the bundle pawl 61 may start at the same time with the movement of the ejector 56. In other words, the process of ACT 01 and the process of ACT 02 may start at the same time.

Figure 10:
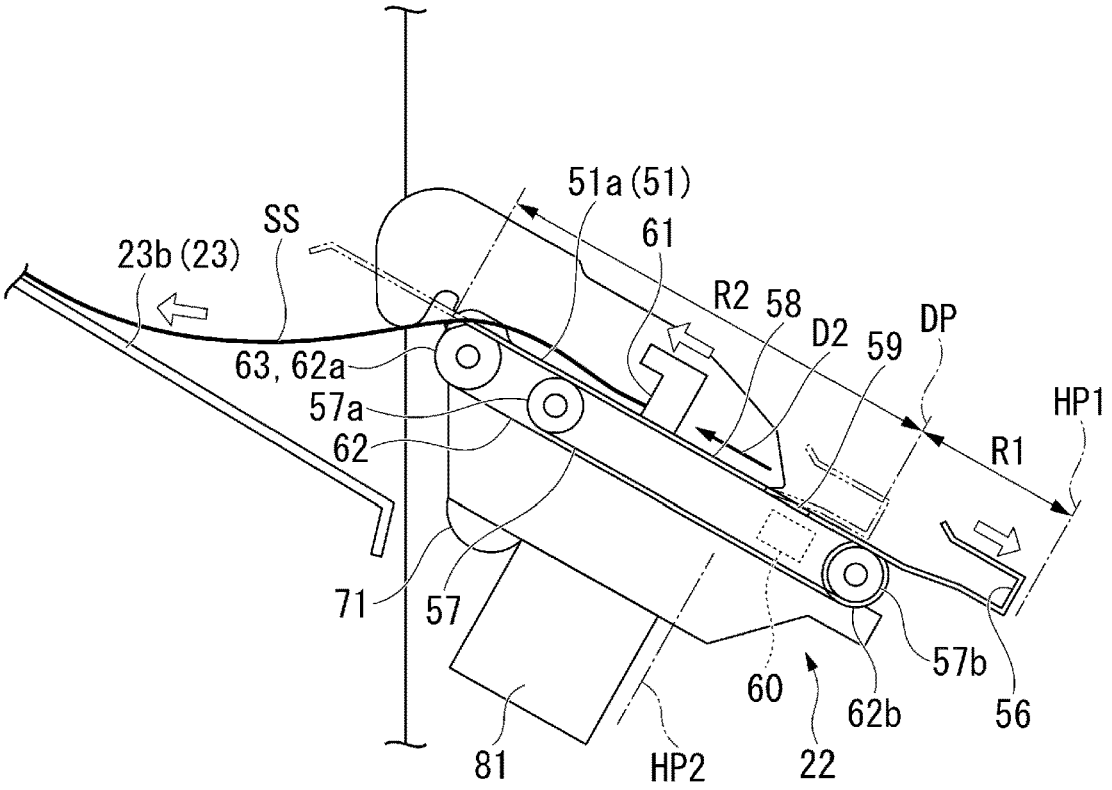
FIG. 10 is a side view illustrating an operation state in the discharging of the sheet processing device.

Next, the post-processing control unit 25 moves the bundle pawl 61 from the delivery position DP in the sheet conveyance direction (ACT 03). As illustrated in FIG. 10, the bundle pawl 61 receives the sheet bundle SS from the ejector 56 at the delivery position DP, and extrudes the sheet bundle SS to the movable tray 23*b* on the downstream side in the sheet conveyance direction.

Next, the post-processing control unit 25 moves the ejector 56 from the delivery position DP toward the home position HP1 (ACT 04). As illustrated in FIG. 10, the post-processing control unit 25 causes the driving current to flow to the first motor 71, and moves the ejector 56 and the thruster 58 at a first speed by the first motor 71. For example, the post-processing control unit 25 moves the ejector 56 and the thruster 58 when the sheet bundle SS starts to be conveyed by the bundle pawl 61. Further, the movement of the ejector 56 may be restarted before the sheet bundle SS is conveyed by the bundle pawl 61. In other words, the post-processing control unit 25 may performs the process of ACT 04 before the process of ACT 03. The post-processing control unit 25 causes the thruster 58 to recede onto the upstream side in the sheet conveyance direction before the bundle pawl 61 reaches the end of the processing tray 51 on the downstream side in the sheet conveyance direction. In other words, the post-processing control unit 25 causes the thruster 58 to recede onto the upstream side in the sheet conveyance direction before the sheet bundle SS is completely conveyed by the bundle pawl 61.

Next, the post-processing control unit 25 decelerates the ejector 56 by reducing the output power of the first motor 71 before the ejector 56 reaches the home position HP1 (ACT 05). In other words, the post-processing control unit 25 causes the ejector 56 to reach the home position HP1 at a second speed which is slower than the first speed.

Next, the post-processing control unit 25 fixes the ejector 56 to the home position HP1 (ACT 06). The post-processing control unit 25 locates the ejector 56 at the home position HP1, and causes the holding current to flow to the first motor 71 during a period when the second motor 81 drives. The post-processing control unit 25 fixes the output shaft of the first motor 71 by the holding current flowing to the first motor 71. A holding power of fixing the output shaft of the first motor 71 is set to be larger than a friction force between the ejector drive mechanism 70 and the bundle pawl drive mechanism 80, and the output shaft of the first motor 71 is fixed. In this embodiment, the friction force between the ejector drive mechanism 70 and the bundle pawl drive mechanism 80 is a friction force between the first pulley 73 and the shaft 77. As illustrated in FIG. 5, when the output shaft of the first motor 71 is fixed, the rotation of the first pulley 73 of the ejector drive mechanism 70 is restricted. With this configuration, the power transmission from the bundle pawl drive mechanism 80 passing through the shaft 77 to the first pulley 73 is blocked, and the ejector 56 and the thruster 58 are fixed.

Figure 11:
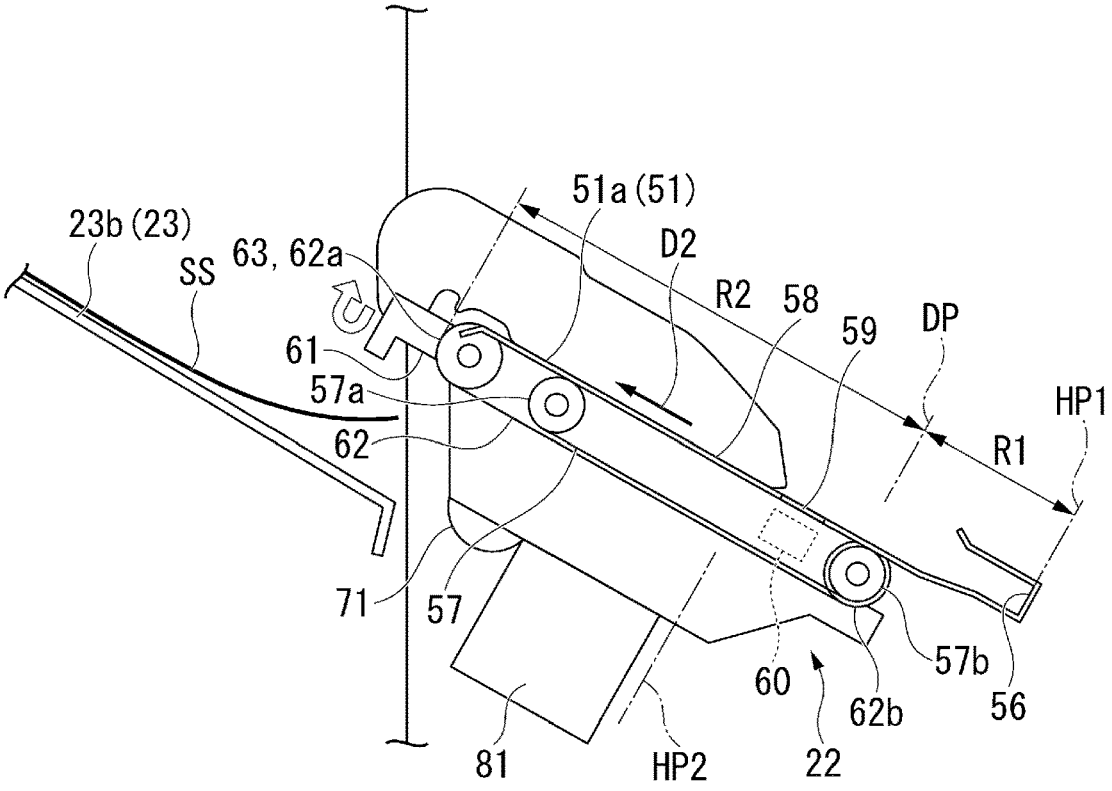
FIG. 11 is a side view illustrating an operation state in the discharging of the sheet processing device.
Figure 12:
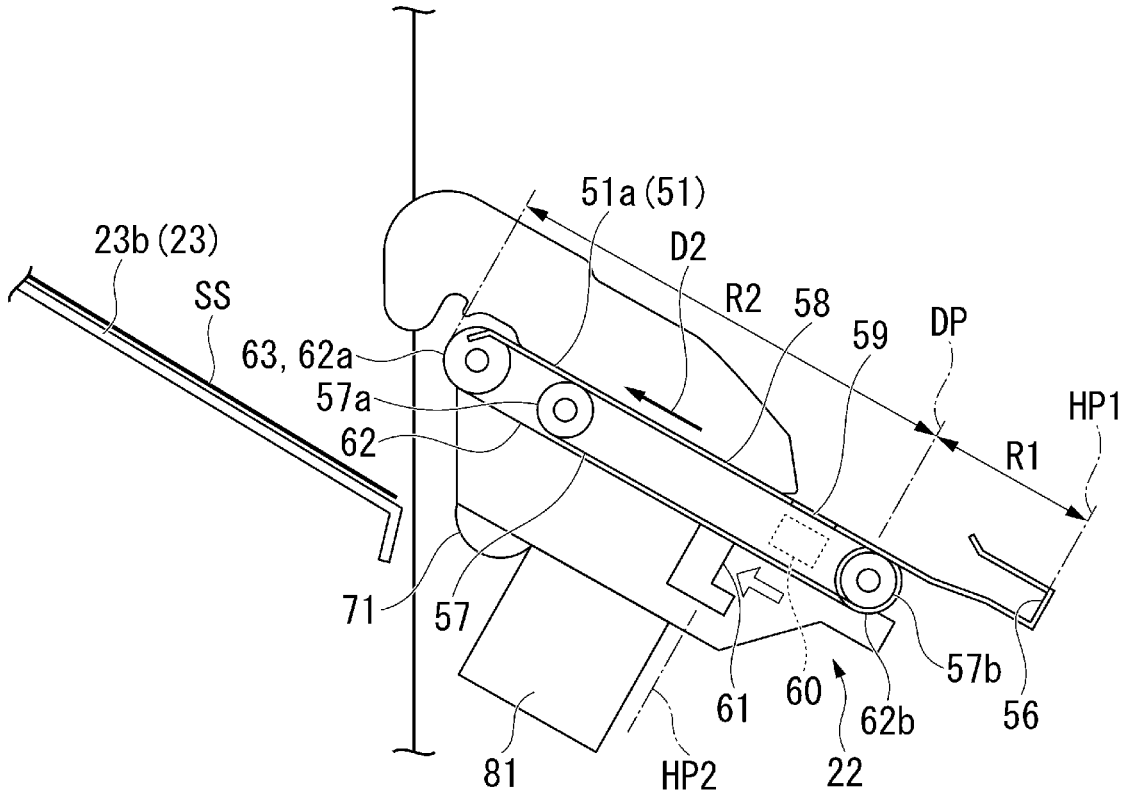
FIG. 12 is a side view illustrating an operation state in the discharging of the sheet processing device.

Next, the post-processing control unit 25 returns the bundle pawl 61 to the home position HP2 after the conveyance of the sheet bundle SS is completed (ACT 07). As illustrated in FIG. 11, the post-processing control unit 25 drives and rotates the bundle pawl belt 62 in the opposite direction by the second motor 81 at the end in the second region R2 on the downstream side. For example, the opposite direction is a clockwise direction in FIG. 3. At this time, the post-processing control unit 25 may stop the output of the holding current to the first motor 71. As illustrated in FIG. 12, the bundle pawl 61 reaches the home position HP2 so that the discharging is completed.

The sheet processing device 3 of the above-described embodiment includes the ejector 56, the bundle pawl 61, the first motor 71, and the second motor 81. The ejector 56 moves along the sheet conveyance direction while coming into contact with the sheet S in the first region R1 of the sheet conveyance direction. The bundle pawl 61 extrudes the sheet S toward the sheet conveyance direction in the second region R2 on the downstream side from the first region R1 in the sheet conveyance direction. The first motor 71 drives the ejector 56. The second motor 81 drives the bundle pawl 61. The second motor 81 is provided separately from the first motor 71. With this configuration, when the moving ejector 56 is stopped, the ejector 56 can be decelerated by reducing the output of the first motor 71. Therefore, it is possible to suppress an impact noise when the moving ejector 56 is stopped.

Further, the sheet processing device 3 includes the first power transmission unit 72, the second power transmission unit 82, and the shaft 77. The first power transmission unit 72 transfers power from the first motor 71 to the ejector 56. The first power transmission unit 72 includes the first pulley 73. The second power transmission unit 82 transfers power from the second motor 81 to the bundle pawl 61. The second power transmission unit 82 includes the second pulley 83 and the third pulley 84. The shaft 77 supports the first pulley 73, the second pulley 83, and the third pulley 84. Therefore, the shaft members for supporting the first pulley 73, the second pulley 83, and the third pulley 84 can be commonly configured. Therefore, it is possible to minimize the sheet processing device compared to a case where the first pulley, the second pulley, and the third pulley are supported by the different shaft members. With the above-described configuration, it is possible to obtain the sheet processing device 3 which is quite while suppressing an increase in size.

In addition, since the ejector 56 is driven by the first motor 71, the sheet processing device 3 does not need to provide a spring for recovery of the ejector 56. Therefore, a failure related to the spring is suppressed, and a reliability of the sheet processing device 3 can be improved.

In addition, the second pulley 83 and the third pulley 84 are fixed to the shaft 77. A bearing is interposed between the first pulley 73 and the shaft 77. With this configuration, it is possible to suppress that the first pulley 73 from rotating around the second pulley 83 and the third pulley 84. Therefore, the ejector 56 and the bundle pawl 61 can be more securely driven independently. Therefore, an unintended operation can be suppressed in the ejector 56 and the bundle pawl 61, and the sheet S can be accurately conveyed.

In addition, the sheet processing device 3 includes the ejector sensor 60 which detects the position of the ejector 56. With this configuration, it is possible to suppress a positional deviation of the ejector 56. Therefore, the sheet S can be accurately conveyed.

In addition, the post-processing control unit 25 causes the holding current smaller than the driving current to flow to the first motor 71 when the second motor 81 is driven. With this configuration, since the output shaft of the first motor 71 is fixed, an unintended operation of the ejector 56 according to the operation of the bundle pawl 61 can be suppressed. Therefore, the sheet S can be accurately conveyed.

Further, the post-processing control unit 25 changes the magnitude of the current flowing to the first motor 71 to determine the movement of the ejector 56 by the ejector sensor 60. The post-processing control unit 25 sets the current flowing to the first motor 71 to the holding current when the ejector 56 does not move. With this configuration, even if a manufacturing deviation occurs in the first motor 71, the holding current can be accurately set.

In addition, the post-processing control unit 25 changes the position of the ejector 56 according to the position where the stapling is performed on the sheet bundle SS. With this configuration, the stapling can be performed at a position different from the reference position with respect to the sheet bundle SS.

In addition, the first power transmission unit 72 is configured by a plurality of rotors and at least one of the belts suspended on the plurality of rotors. The plurality of rotors include the first pulley 73, the first belt roller 57*a*, and the second belt roller 57*b*. At least one belt includes the first transferring belt 74, the second transferring belt 75, and the ejector belt 57. With this configuration, there occurs no operation noise caused by backlash of the gear like a case where the first power transmission unit includes a plurality of gears which are coupled to each other. Therefore, it is possible to achieve the quite sheet processing device 3.

In addition, the ejector 56 comes into contact with the clip 59 and the processing tray 51, and the movement to the upstream side in the sheet conveyance direction in the home position HP1 is restricted. With this configuration, the ejector 56 can be easily located in the home position HP1. Further, as described above, the sheet processing device 3 of the embodiment can decelerate the ejector 56 when the moving ejector 56 is stopped. Therefore, the impact noise can be effectively suppressed in this configuration where the impact noise easily occurs when the clip 59 of the ejector 56 and the processing tray 51 come into contact.

In addition, the sheet processing device 3 includes the thruster 58 which is formed to protrude toward the downstream side in the sheet conveyance direction from the processing tray 51. The post-processing control unit 25 causes the thruster 58 to recede into the upstream side in the sheet conveyance direction before the conveyance of the sheet S is completed by the bundle pawl 61. With this configuration, when the bundle pawl 61 reaches the end of the processing tray 51 of the sheet conveyance direction on the downstream side, the thruster 58 protrudes from the processing tray 51. Therefore, the bundle pawl 61 and the thruster 58 are not overlapped when viewed from the sheet width direction. Therefore, the end of the sheet S on the upstream side in the sheet conveyance direction is not supported by the thruster 58, and extruded to the bundle pawl 61. Therefore, it is possible to suppress that the sheet S is interposed by the thruster 58 and the bundle pawl 61 and stained.

Further, in the above embodiment, the ejector 56 is provided in plural places. However, the ejector may be not provided only by one.

In addition, in the above embodiment, the first power transmission unit 72 is configured by the rotating body and the belt. However, the first power transmission unit may include gears which are meshed to each other.

In addition, in the above embodiment, the rolling bearing is interposed between the first pulley 73 and the shaft 77. However, a slide bearing may be interposed instead of the rolling bearing.

In addition, the bearing may not be interposed between the first pulley 73 and the shaft 77. The first pulley 73 may be rotatable with respect to the shaft 77 when the holding current flows to the first motor 71 to fix the output shaft of the first motor.

In addition, in the above embodiment, the first pulley 73 is provided to be rotatable with respect to the shaft 77. However, the first pulley may be fixed to the shaft. In that case, the second pulley and the third pulley are provided rotatably about the shaft while fixing the second pulley and the third pulley of the bundle pawl drive mechanism to each other.

In addition to the first pulley 73, the second pulley and the third pulley may also be provided rotatably with respect to the shaft. In other words, the shaft members for supporting the first pulley, the second pulley, and the third pulley may be commonly configured.

In addition, in the above embodiment, the second pulley 83 and the third pulley 84 are provided separately. However, these pulleys may be integrally formed.

In addition, in the above embodiment, the sheet bundle SS is bound by the stapler 55. However, the sheet bundle SS may be bound by pressing without using the staple for example.

In addition, in the above embodiment, the image forming system 1 has been described which includes the image forming device 2 as the image processing system provided with the sheet processing device 3, but the embodiment is not limited thereto. The image processing system provided with the sheet processing device 3 may be a decoloring device which performs decoloring on the sheet with an image formed.

According to at least one embodiment described above, the sheet processing device includes the ejector, the bundle pawl, the first motor, and the second motor. The first motor drives the ejector. The second motor drives the bundle pawl. The second motor is provided separately from the first motor. With this configuration, the impact noise can be suppressed when the moving ejector is stopped. Further, the sheet processing device includes the first power transmission unit, the second power transmission unit, and the shaft. The first power transmission unit transfers power from the first motor to the ejector. The first power transmission unit includes the first pulley. The second power transmission unit transfers power from the second motor to the bundle pawl. The second power transmission unit includes the second pulley and the third pulley. The shaft supports the first pulley, the second pulley, and the third pulley. With this configuration, the sheet processing device can be made compact compared to a case where the first pulley, the second pulley, and the third pulley are supported by different shaft members. Therefore, it is possible to provide a quite sheet processing device which is suppressed in size.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and there equivalents are intended to cover such forms or modifications as would fall within the scope and spirit of the invention.

What is claimed is:

1. A sheet processing device, comprising:

a processing tray configured to mount a sheet;

a moving member configured to contact an end of the sheet mounted in the processing tray on an upstream side in a sheet conveyance direction, and to move along the sheet conveyance direction while contacting the sheet in a first region in the sheet conveyance direction;

an extrusion member configured to contact an end of the sheet mounted in the processing tray on the upstream side in the sheet conveyance direction, and to extrude the sheet from the upstream side toward a downstream side in the sheet conveyance direction in a second region on the downstream side from the first region in the sheet conveyance direction;

a first motor configured to drive the moving member;

a second motor configured to drive the extrusion member and separated from the first motor;

a first power transmission unit including a first rotor and configured to transfer power from the first motor to the moving member;

a second power transmission unit including a second rotor and configured to transfer power from the second motor to the extrusion member; and a shaft configured to support the first rotor and the second rotor.

2. The device according to claim 1, further comprising:

a control unit configured to control the first motor and the second motor, wherein, when the second motor is driven, the control unit causes a holding current to flow to the first motor, the holding current being smaller than a driving current flowing to the first motor when driving the moving member and larger than "0".

3. The device according to claim 2, further comprising:

a detection device configured to detect a position of the moving member, wherein the control unit changes a magnitude of a current flowing to the first motor to determine whether the moving member is moved by the detection device, and sets a current flowing to the first motor to the holding current if the moving member is not moved.

4. The device according to claim 1, wherein the second rotor is fixed to the shaft, and a bearing is interposed between the first rotor and the shaft.

5. The device according to claim 1, further comprising:

a detection device configured to detect a position of the moving member.

6. The device according to claim 1, further comprising:

a binding unit mounted in the processing tray and configured to perform a sheet binding on a sheet bundle which comes into contact with the moving member; and a control unit configured to control the first motor, wherein the control unit controls the first motor to change a position of the moving member according to a position where the sheet binding is performed on the sheet bundle.

7. The device according to claim 1, wherein the first power transmission unit comprises a plurality of rotating bodies which includes the first rotor, and at least one belt which is suspended on the plurality of rotating bodies.

8. The device according to claim 1, wherein because of the contact between the moving member or a member fixed to the moving member and the processing tray or a member fixed to the processing tray, the movement of the moving member toward the upstream side in the sheet conveyance direction in an end in the first region on the upstream side in the sheet conveyance direction is regulated.

9. The device according to claim 1, further comprising:

a guide member configured to move along the sheet conveyance direction together with the moving member, and to protrude toward a downstream side in the sheet conveyance direction from the processing tray; and a control unit configured to control the first motor and the second motor, wherein the control unit controls the first motor to cause the guide member to recede into the upstream side in the sheet conveyance direction before the sheet is completely conveyed by the extrusion member.

10. An image processing system, comprising:

the sheet processing device according to claim 1; and an image processing device configured to process an image on the sheet to convey the sheet to the sheet processing device.

11. A sheet processing method, comprising:

contacting an end of a sheet mounted in a processing tray on an upstream side in a sheet conveyance direction with a moving member, and moving the moving member along the sheet conveyance direction while contacting the sheet in a first region in the sheet conveyance direction;

contacting an end of the sheet mounted in the processing tray on the upstream side in the sheet conveyance direction with an extrusion member, and extruding the sheet from the upstream side toward a downstream side in the sheet conveyance direction in a second region on the downstream side from the first region in the sheet conveyance direction;

driving the moving member with a first motor;

driving the extrusion member with a second motor, the second motor separated from the first motor;

transferring power from the first motor to the moving member with a first power transmission unit including a first rotor;

transferring power from the second motor to the extrusion member with a second power transmission unit including a second rotor; and supporting the first rotor and the second rotor with a shaft.

12. The method according to claim 11, further comprising:

when the second motor is driven, causing a holding current to flow to the first motor, the holding current being smaller than a driving current flowing to the first motor when driving the moving member and larger than "0".

13. The method according to claim 12, further comprising:

detecting a position of the moving member, changing a magnitude of a current flowing to the first motor to determine whether the moving member is moved, and setting a current flowing to the first motor to the holding current if the moving member is not moved.

14. The method according to claim 11, wherein the second rotor is fixed to the shaft, and a bearing is interposed between the first rotor and the shaft.

15. The method according to claim 11, further comprising:

detecting a position of the moving member.

16. The method according to claim 11, further comprising:

sheet binding on a sheet bundle which comes into contact with the moving member; and changing a position of the moving member according to a position where the sheet binding is performed on the sheet bundle.

17. The method according to claim 11, wherein the first power transmission unit comprises a plurality of rotating bodies which includes the first rotor, and at least one belt suspended on the plurality of rotating bodies.

18. The method according to claim 11, regulating the movement of the moving member toward the upstream side in the sheet conveyance direction in an end in the first region on the upstream side in the sheet conveyance direction by contact between the moving member or a member fixed to the moving member and the processing tray or a member fixed to the processing tray.

19. The method according to claim 11, further comprising:

moving a guide member along the sheet conveyance direction together with the moving member, and protruding the guide member toward a downstream side in the sheet conveyance direction from the processing tray; and causing the guide member to recede into the upstream side in the sheet conveyance direction before the sheet is completely conveyed by the extrusion member.

20. The method according to claim 11, further comprising:

forming an image on the sheet.

* * * * *